US012264675B2

(12) United States Patent
Awa et al.

(10) Patent No.: US 12,264,675 B2
(45) Date of Patent: Apr. 1, 2025

(54) ELECTRIC COMPRESSOR

(71) Applicant: KABUSHIKI KAISHA TOYOTA JIDOSHOKKI, Aichi (JP)

(72) Inventors: Toshiharu Awa, Kariya (JP); Takayuki Kato, Kariya (JP); Toshiyuki Miyano, Kariya (JP); Noritaka Nishimori, Kariya (JP); Toshiyuki Kobayashi, Kariya (JP); Yasuaki Nakano, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 78 days.

(21) Appl. No.: 18/109,926

(22) Filed: Feb. 15, 2023

(65) Prior Publication Data

US 2023/0287887 A1 Sep. 14, 2023

(30) Foreign Application Priority Data

Mar. 9, 2022 (JP) ..... 2022-036084

(51) Int. Cl.
*F04C 29/06* (2006.01)
*F04C 18/02* (2006.01)

(52) U.S. Cl.
CPC ..... *F04C 29/063* (2013.01); *F04C 18/0215* (2013.01)

(58) Field of Classification Search
CPC ..... F04C 18/0215; F04C 29/063
See application file for complete search history.

(56) References Cited

U.S. PATENT DOCUMENTS

| | | | | |
|---|---|---|---|---|
| 4,034,916 | A * | 7/1977 | Forsberg | B05B 7/2494 220/4.21 |
| 6,177,018 | B1 | 1/2001 | Ruppenthal | |
| 6,692,240 | B1 | 2/2004 | Leonhard et al. | |
| 2022/0243711 | A1 | 8/2022 | Kato et al. | |

FOREIGN PATENT DOCUMENTS

| | | | |
|---|---|---|---|
| DE | 19639666 | C1 | 10/1998 |
| DE | 60027202 | T2 | 12/2006 |
| DE | 102013004906 | A1 | 9/2014 |
| DE | 102022101356 | A1 | 8/2022 |
| JP | H04358777 | A * | 11/1991 |
| JP | H05-321839 | A | 12/1993 |
| JP | 2003293957 | A * | 10/2003 |

OTHER PUBLICATIONS

Translation of JP2003293957A (Kato) (Year: 2003).*

* cited by examiner

*Primary Examiner* — Connor J Tremarche
(74) *Attorney, Agent, or Firm* — Greenblum & Bernstein, P.L.C.

(57) ABSTRACT

An electric compressor includes a compression part configured to compress fluid, an electric motor configured to drive the compression part, a housing accommodating the compression part and the electric motor, a soundproof cover covering the housing, and a nameplate attached to the housing and including a predetermined information. The housing includes a protrusion that is a part of the housing and protrudes out of the soundproof cover through a hole formed in the soundproof cover. The nameplate is provided on the protrusion.

12 Claims, 4 Drawing Sheets

ELECTRIC COMPRESSOR

CROSS-REFERENCE TO RELATED APPLICATION

This application claims priority to Japanese Patent Application No. 2022-036084 filed on Mar. 9, 2022, the entire disclosure of which is incorporated herein by reference.

BACKGROUND ART

The present disclosure relates to an electric compressor.

Japanese Patent Application Publication No. H05-321839 discloses a soundproof structure of a compressor for a refrigeration machine.

The above-mentioned compressor includes a compression mechanism, a driving motor, a casing, a soundproof cover, and a nameplate. The compression mechanism compresses refrigerant. The driving motor drives the compression mechanism. The casing has therein the compression mechanism and the driving motor. Information such as a model name of the compressor is shown on the nameplate. The nameplate is attached to an outer peripheral surface of the casing. The soundproof cover covers the outer peripheral surface of the casing. The soundproof cover suppresses noise of the compressor.

When the outer peripheral surface of the casing is covered with the soundproof cover, the nameplate cannot be checked from outside the compressor. Therefore, in order to check the nameplate from outside the compressor, for example, the nameplate may be provided on the outer surface of the soundproof cover. However, the soundproof cover is usually made of a material different from that of the casing (e.g., resin such as a urethane material), and requires adhesive suitable for the material of the soundproof cover. With adhesive for the casing, the nameplate does not adequately adhere to the soundproof cover. That is, the nameplate may not be stably attached to the soundproof cover. Therefore, there is a demand for increasing reliability in attaching the nameplate.

SUMMARY

According to one aspect of the present disclosure, there is provided an electric compressor including a compression part configured to compress fluid, an electric motor configured to drive the compression part, a housing accommodating the compression part and the electric motor, a soundproof cover covering the housing, and a nameplate attached to the housing and including a predetermined to information. The housing includes a protrusion that is a part of the housing and protrudes out of the soundproof cover through a hole formed in the soundproof cover. The nameplate is provided on the protrusion.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

First Embodiment

Figure 1:
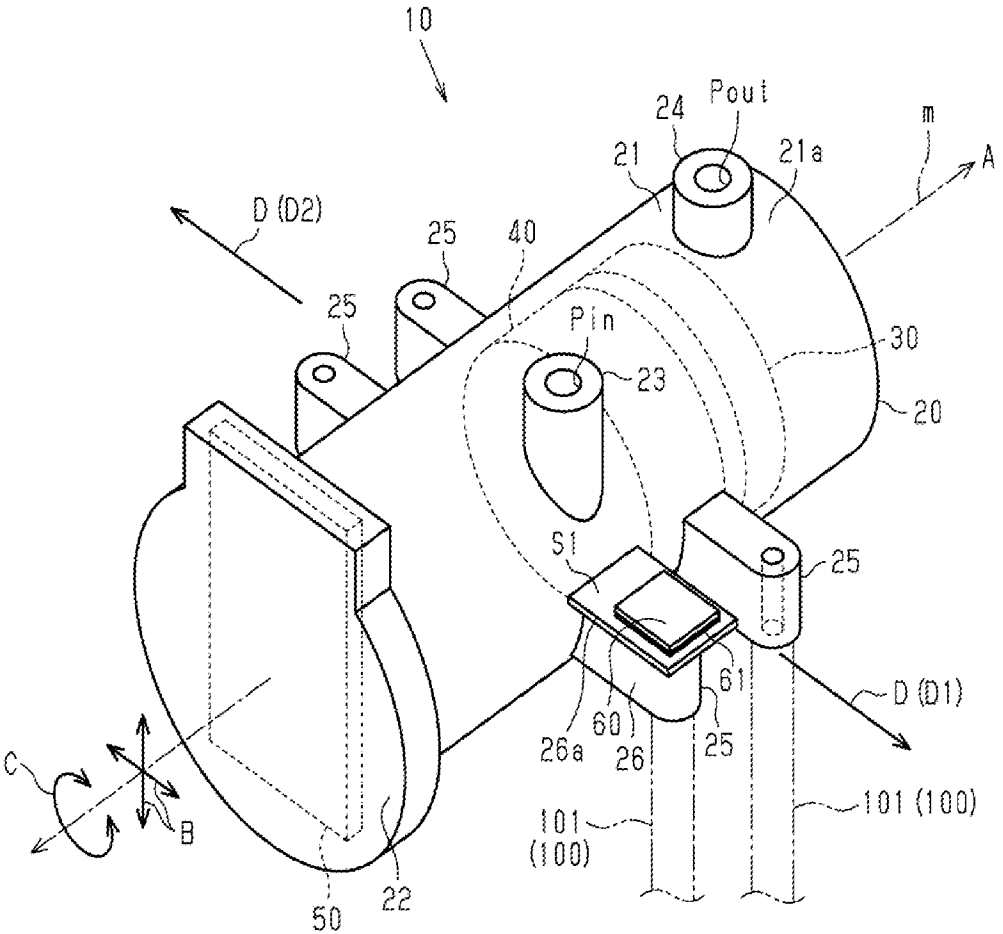
FIG. 1 is a schematic view illustrating an electric compressor from which a soundproof cover is removed.
Figure 2:
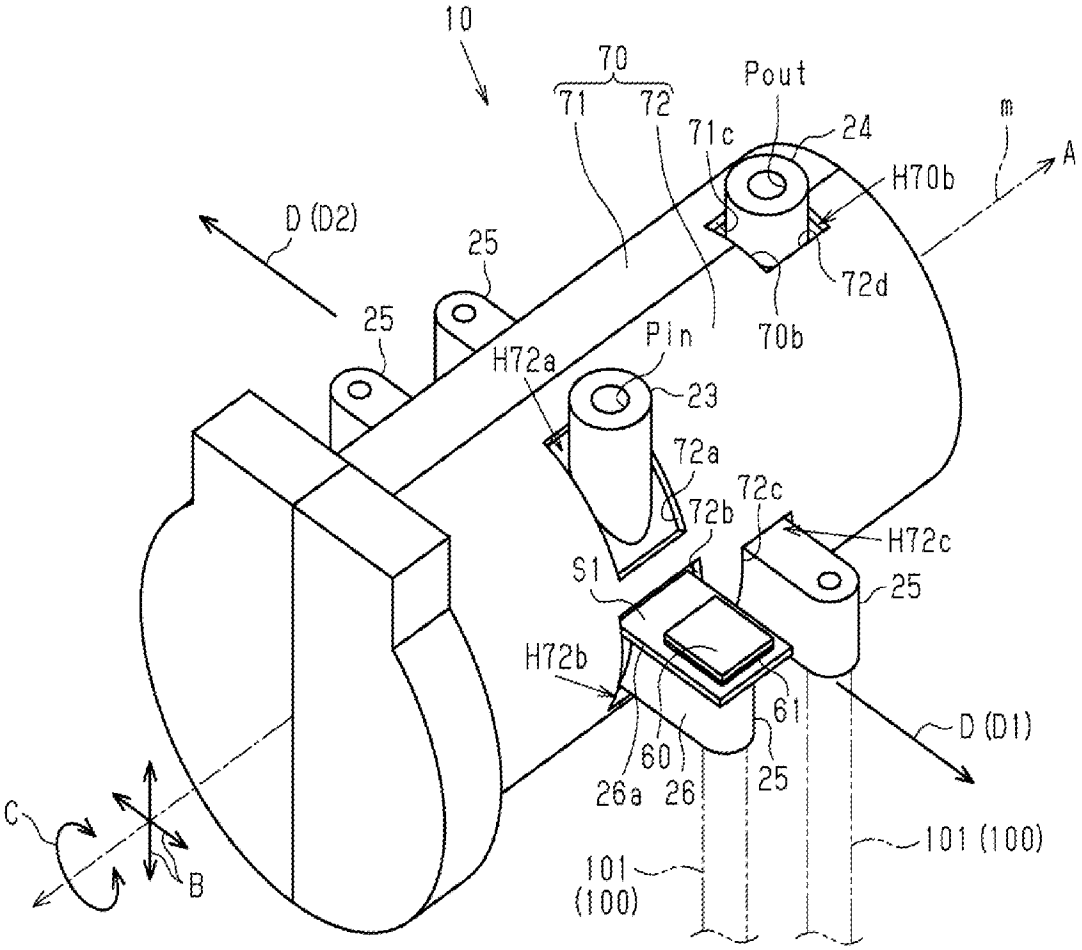
FIG. 2 is a schematic view illustrating the electric compressor according to a first embodiment in which a housing is covered with the soundproof cover.
Figure 3:
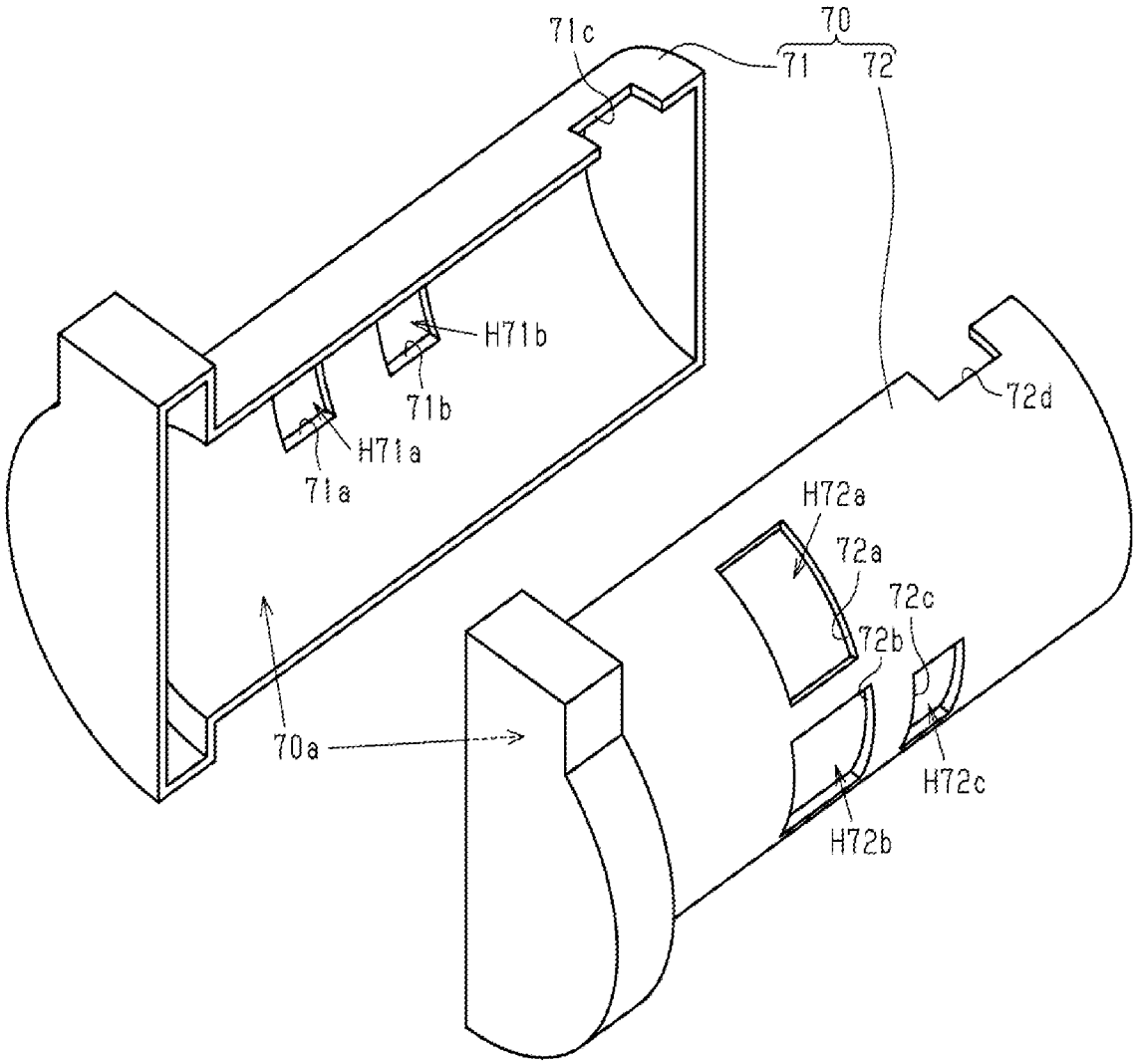
FIG. 3 is a schematic view illustrating the soundproof cover.

The following will describe an electric compressor according to a first embodiment with reference to FIGS. 1 to 3. The electric compressor of the present embodiment is used, for example, for a vehicle air conditioner.

<Basic Configuration of Electric Compressor>

As illustrate in FIGS. 1 and 2, an electric compressor 10 includes a housing 20 and a soundproof cover 70. As illustrated in FIG. 1, the housing 20 has a cylindrical shape. The housing 20 is made of metal. For example, the housing 20 is made of aluminum. A direction in which an axial line m of the housing 20 extends is referred to as an axial direction A. A direction extending perpendicularly to the axial line m of the housing 20 is referred to as a radial direction B. A direction in which a circle extends with the axial line m of the housing 20 at the center is referred to as a circumferential direction C. It is noted that the housing 20 is formed of a plurality of housing forming members dividable in the axial direction A.

The electric compressor 10 includes a compression part 30 configured to compress refrigerant as fluid, an electric motor 40 configured to drive the compression part 30, an inverter 50 configured to drive the electric motor 40, and a nameplate 60. The housing 20 accommodates the compression part 30, the electric motor 40, and the inverter 50. The compression part 30, the electric motor 40, and the inverter 50 are arranged in this order in the axial direction A of the housing 20. The electric motor 40 operates with a supply of electric power from the inverter 50. The compression part 30 is a scroll type compression part that includes a fixed scroll and a movable scroll, which are not illustrated. The compression part 30 is configured to compress refrigerant introduced into the housing 20 with the operation of the electric motor 40.

<Configuration of Housing>

The housing 20 has a first accommodation portion 21 and a second accommodation portion 22. The first accommodation portion 21 has a cylindrical shape forming the outline of the housing 20, and an axial line of the first accommodation portion 21 coincides with the axial line m of the housing 20. The first accommodation portion 21 accommodates the compression part 30 and the electric motor 40. The second accommodation portion 22 accommodates the inverter 50. The first accommodation portion 21 is disposed side-by-side with the second accommodation portion 22 in the axial direction A.

The housing 20 has a suction port wall 23 having a cylindrical shape, a discharge port wall 24 having a cylindrical shape, and a plurality of mounting legs 25. The suction port wall 23 is formed in an outer peripheral surface 21*a* of the first accommodation portion 21.

<Configuration of Suction Port Wall>

The suction port wall 23 protrudes from the outer peripheral surface 21*a* of the first accommodation portion 21. The suction port wall 23 is a part of the housing 20. The suction port wall 23 is disposed between the electric motor 40 and the inverter 50 in the axial direction A. The suction port wall 23 has a suction port Pin in communication with an inside of the first accommodation portion 21. With the operation of the electric motor 40, refrigerant to be compressed by the compression part 30 is introduced into the first accommodation portion 21 through the suction port Pin. The suction port Pin is a port formed by the suction port wall 23. Thus, the suction port wall 23 corresponds to a wall forming the suction port Pin.

<Configuration of Discharge Port Wall>

The discharge port wall 24 protrudes from the outer peripheral surface 21*a* of the first accommodation portion 21. The discharge port wall 24 is a part of the housing 20. The discharge port wall 24 protrudes from the outer peripheral surface 21*a* in the same direction as the suction port wall 23. The discharge port wall 24 is disposed substantially at the same position as the compression part 30 in the axial direction A. The discharge port wall 24 has a discharge port Pout in communication with the inside of the first accommodation portion 21. The discharge port Pout is in communication with the compression part 30. Refrigerant compressed in the compression part 30 is discharged to an outside of the first accommodation portion 21 from the discharge port Pout. The discharge port Pout is a port formed by the discharge port wall 24. Thus, the discharge port wall 24 corresponds to a wall forming the discharge port Pout. Thus, the electric compressor 10 of the present embodiment has a port through which refrigerant is introduced or discharged.

<Configuration of Mounting Leg>

The present embodiment includes four mounting legs 25. All of the mounting legs 25 are parts of the housing 20. All of the mounting legs 25 protrude from the outer peripheral surface 21*a* of the first accommodation portion 21. All of the mounting legs 25 extend in a direction perpendicular to a direction in which the suction port wall 23 and the discharge port wall 24 protrude from the outer peripheral surface 21*a*, for example. A direction in which the mounting legs protrude is referred to as a protruding direction D.

In a more detailed example, two of the mounting legs 25 protrude in a first direction D1 corresponding to one direction of the protruding direction D. The other two of the mounting legs 25 protrude in a second direction D2 corresponding to a direction opposite from the first direction D1.

The two mounting legs 25 protruding in the first direction D1 are disposed side-by-side in the axial direction A. The two mounting legs 25 protruding in the second direction D2 are disposed side-by-side in the axial direction A. One of the two mounting legs 25 protruding in the first direction D1, which is positioned closer to the second accommodation portion 22, is referred to as a nameplate mounting leg 26.

The nameplate mounting leg 26 is positioned closest to the suction port wall 23 among all of the mounting legs 25. The nameplate mounting leg 26 is positioned closest to the suction port Pin among all of the mounting legs 25.

The nameplate mounting leg 26 is positioned substantially at the same position as the suction port wall 23 in the axial direction A. One of the two mounting legs 25 protruding in the second direction D2, which is positioned closer to the suction port wall 23, is positioned substantially at the same position with the suction port wall 23 in the axial direction A. The nameplate mounting leg 26 is positioned farther from the discharge port Pout than the other mounting legs 25. One of the two mounting legs 25 protruding in the second direction D2, which is positioned closer to the suction port wall 23, is positioned farther from the discharge port Pout than the other mounting legs 25. The nameplate mounting leg 26 is positioned farthest from the discharge port Pout, of all of the mounting legs 25.

A flat plate 26*a* is formed integrally with the nameplate mounting leg 26. The flat plate 26*a* is formed in a portion of the nameplate mounting leg 26 facing the suction port wall 23 in the circumferential direction C. The flat plate 26*a* has a flat surface S1. The flat surface S1 is positioned in a direction in which the suction port wall 23 and the discharge port wall 24 protrude from the outer peripheral surface 21*a* in the flat plate 26*a*.

The two mounting legs 25 protruding in the first direction D1 are mounted to a mounting portion 101 protruding from a vehicle body 100 serving as a mounting object. Although it is not illustrated, the two mounting legs 25 protruding in the second direction D2 are also mounted to the mounting portion 101 of the vehicle body 100. Thus, all of the mounting legs 25 correspond to mounting legs for mounting the electric compressor 10 to the vehicle body 100.

<Configuration of Nameplate>

In the present embodiment, the nameplate 60 is a sticker having a rectangular shape and made of a flexible material. The size of the nameplate 60 is smaller than the flat surface S1 of the nameplate mounting leg 26. The nameplate 60 is adhered to the flat surface S1 of the flat plate 26*a* of the nameplate mounting leg 26 by interposing an adhesive layer 61 formed of adhesive. In this way, the nameplate 60 is attached to the housing 20.

The nameplate 60 includes predetermined information. In detail, the predetermined information is shown on a surface of the nameplate 60 opposite from the adhesive layer 61. The predetermined information includes, for example, a product number of the electric compressor 10, a lot number of the electric compressor 10 at the time of manufacturing, and precautions for use of the electric compressor 10. The predetermined information may be a QR code (registered trademark) including all pieces of the above-mentioned information.

<Configuration of Soundproof Cover>

As illustrated in FIGS. 2 and 3, the soundproof cover 70 is made of elastically deformable material such as resin. The soundproof cover 70 is, for example, made of a urethane material or unwoven cloth.

As illustrated in FIG. 3, the soundproof cover 70 includes a first cover 71 and a second cover 72. Each of the first cover 71 and the second cover 72 has an accommodation recess 70*a* extending along the outline of the housing 20. The first cover 71 has a first insertion portion 71*a* and a second insertion portion 71*b*, and the first insertion portion 71*a* and the second insertion portion 71*b* form a first hole H71*a* and a second hole H71*b*, respectively, in the first cover 71. That is, the first insertion portion 71*a* is a surface forming the first hole H71*a*, and the second insertion portion 71*b* is a surface forming the second hole H71*b*. The first hole H71*a* and the second hole H71*b* are holes formed in the soundproof cover 70.

As illustrated in FIGS. 2 and 3, the two mounting legs 25 protruding in the second direction D2 are inserted through the first hole H71*a* and the second hole H71*b*, respectively.

The second cover 72 has a suction port wall insertion portion 72*a*, a third insertion portion 72*b*, and a fourth insertion portion 72*c*, and the suction port wall insertion portion 72*a*, the third insertion portion 72*b*, and the fourth insertion portion 72*c* form a suction port wall insertion hole H72*a*, a third hole H72*b*, and a fourth hole H72*c*, respectively, in the second cover 72. That is, the suction port wall insertion portion 72*a* is a surface forming the suction port wall insertion hole H72*a*, the third insertion portion 72*b* is a surface forming the third hole H72*b*, and the fourth insertion portion 72*c* is a surface forming the fourth hole H72*c*. The suction port wall insertion hole H72*a*, the third hole H72*b*, and the fourth hole H72*c* are holes formed in the soundproof cover 70.

As illustrated in FIG. 2, the suction port wall 23 is inserted through the suction port wall insertion hole H72*a*. The two mounting legs 25 protruding in the first direction D1 are inserted through the third hole H72*b* and the fourth hole H72*c*, respectively. The suction port wall 23 protrudes out of the soundproof cover 70 through the suction port wall insertion hole H72*a*.

The soundproof cover 70 has a discharge port wall insertion portion 70*b* that forms a discharge port wall insertion hole H70*b* in the soundproof cover 70. That is, the discharge port wall insertion portion 70*b* is a surface forming the discharge port wall insertion hole H70*b*. The discharge port wall 24 is inserted through the discharge port wall insertion hole H70*b*. The discharge port wall insertion hole H70*b* is a hole formed in the soundproof cover 70.

As illustrated in FIGS. 2 and 3, the discharge port wall insertion portion 70*b* is formed of a first forming surface 71*c* formed in the first cover 71 and having a U-shape, and a second forming surface 72*d* formed in the second cover 72 and having a U-shape.

As illustrated in FIG. 2, when the housing 20 is covered with the soundproof cover 70, the suction port wall 23, the discharge port wall 24, and all of the mounting legs 25 protrude out of the soundproof cover 70 through the first hole H71*a*, the second hole H71*b*, the suction port wall insertion hole H72*a*, the third hole H72*b*, the fourth hole H72*c*, and the discharge port wall insertion hole H70*b* formed in the soundproof cover 70. The nameplate 60 attached to the flat surface S1 of the nameplate mounting leg 26 protruding out through the third hole H72*b* is exposed to the outside of the soundproof cover 70. In the present embodiment, the mounting legs 25 and the nameplate mounting leg 26 each correspond to a protrusion protruding out of the soundproof cover 70. The nameplate 60 is provided in the nameplate mounting leg 26 corresponding to the protrusion.

<Operation of Embodiment>

The following will describe the operation according to the present embodiment.

In the present embodiment, when the compression part 30 and the electric motor 40 operates, noise is generated through the housing 20. However, since the housing 20 is covered with the soundproof cover 70, the noise of the electric compressor 10 is reduced.

In the present embodiment, the nameplate 60 is provided in the nameplate mounting leg 26 of the housing 20, so that the nameplate 60 can be visually checked when the nameplate mounting leg 26 is seen from outside the electric compressor 10. In addition, the nameplate 60 is attached to the flat surface S1 of the nameplate mounting leg 26 made of metal. Since the nameplate 60 is attached to the housing 20, the nameplate 60 may be attached more stably, as compared with a configuration in which the nameplate 60 is attached to the soundproof cover 70 with adhesion used for attaching the nameplate 60 to the housing 20. As a result, the reliability in attaching the nameplate 60 may be increased.

<Effect of Embodiment>

The following will describe the effects of the present embodiment.

(1-1) The nameplate 60 is attached to the nameplate mounting leg 26 of the housing 20, so that the nameplate 60 is visible. In addition, since the nameplate 60 is provided on the flat surface S1 of the nameplate mounting leg 26 made of metal, the reliability in attaching the nameplate 60 may be increased. According to the present embodiment, the nameplate 60 can be checked from outside the electric compressor 10. In addition to this, the reliability in attaching the nameplate 60 may be increased.

(1-2) In the present embodiment, the nameplate 60 is provided on the mounting legs 25 that is a portion that needs to be protruded out of the soundproof cover 70, that is, the existing protrusion in the housing 20. Thus, the number of holes formed in the soundproof cover 70 may be reduced, as compared with a case where an additional protrusion is formed in the housing 20. As a result, the noise suppression effect of the electric compressor 10 may be maintained.

(1-3) In attaching the nameplate 60 to the housing 20 with the adhesive layer 61, if the temperature of a part of the housing 20 to which the nameplate 60 is attached is high, the adhesive layer 61 deteriorates. Thus, it is difficult to stably maintain the adhesive layer 61.

In the present embodiment, the nameplate 60 is provided on the mounting leg 25 positioned the farthest from the discharge port Pout where the temperature is relatively high in the housing 20. Since the nameplate 60 is attached to the part of the housing 20 where the temperature is relatively low, the adhesive layer 61 may be stably maintained. As a result, the reliability in attaching the nameplate 60 to the nameplate mounting leg 26 may be increased.

In addition, of the mounting legs 25 positioned farther from the discharge port Pout, the nameplate mounting leg 26 is positioned closer to the suction port Pin than the other. Thus, the nameplate 60 is attached to a part of the housing closest to the suction port Pin through which refrigerant having a relatively low temperature is introduced. As a result, the adhesive layer 61 may be maintained more stably, and hence the reliability in attaching the nameplate 60 to the nameplate mounting leg 26 may be increased.

Second Embodiment

Figure 4:
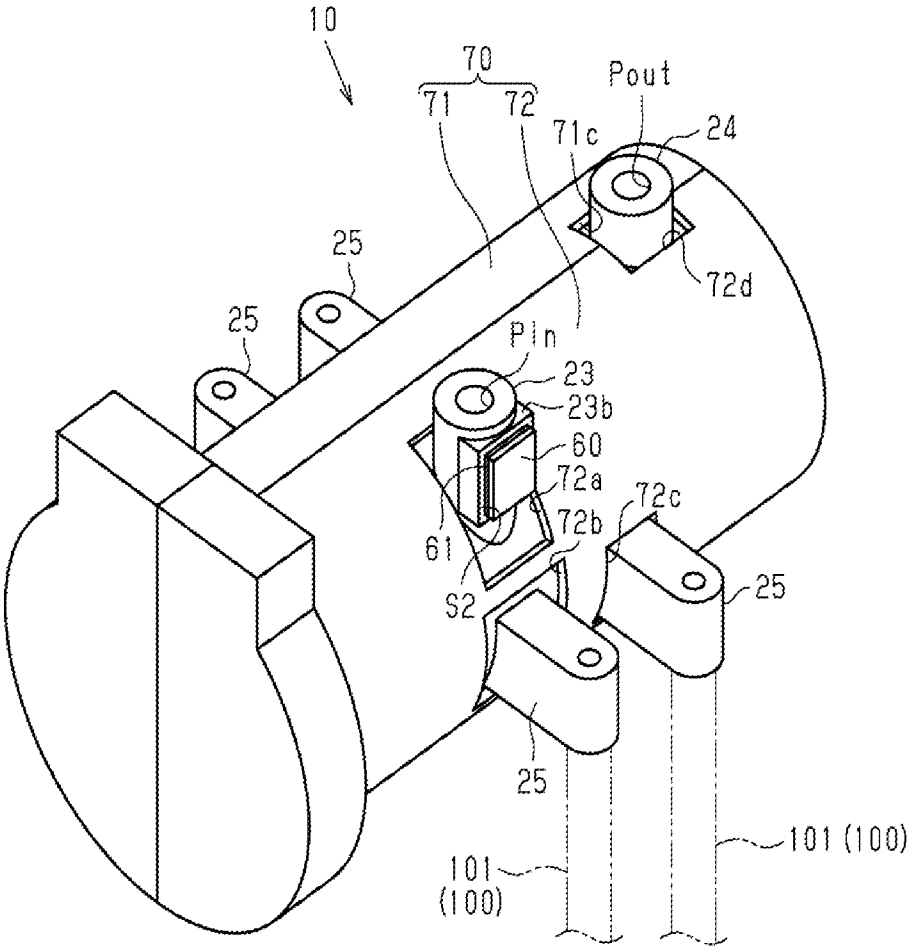
FIG. 4 is a schematic view illustrating an electric compressor according to a second embodiment.

The following will describe an electric compressor according to a second embodiment with reference to FIG. 4. The second embodiment is mainly different from the first embodiment in that the position to which the nameplate is attached is changed In the following, such a difference will be described in detail. Parts the same as those of the first embodiment will be designated with the same reference numerals and the detailed description thereof will be omitted.

<Configuration of Suction Port Wall>

As illustrated in FIG. 4, the suction port wall 23 has a seat portion 23*b*. The seat portion 23*b* is formed by increasing a thickness of a portion of the suction port wall 23. The seat portion 23*b* is formed in a portion of the suction port wall 23 facing the nameplate mounting leg 26 in the circumferential direction C.

The seat portion 23*b* has a flat surface S2. The flat surface S2 is positioned in the seat portion 23*b* on the first direction D1 side. The flat surface S2 is larger than the nameplate 60. The nameplate 60 is adhered to the flat surface S2 of the suction port wall 23 with the adhesive layer 61 interposed therebetween. The suction port wall 23 of the present embodiment corresponds to the protrusion protruding out of the soundproof cover 70.

<Operation and Effect of Embodiment>

The following will explain the operation and effects according to the second embodiment.

(2-1) In the second embodiment, the nameplate 60 is formed in the suction port wall 23 that is a portion that needs to protrude out of the soundproof cover 70, that is, the existing protrusion in the housing 20. Thus, the number of holes formed in the soundproof cover 70 may be reduced, as compared with a case where an additional protrusion is formed in the housing 20. As a result, the noise suppression effect of the electric compressor 10 may be maintained.

(2-2) In attaching the nameplate 60 to the housing 20 with the adhesive layer 61, if the temperature of a part of the housing 20 to which the nameplate 60 is attached is high, the adhesive layer 61 deteriorates. Thus, it is difficult to stably maintain the adhesive layer 61.

According to the second embodiment, the temperature of the suction port wall 23 forming the suction port Pin is lower than that of the discharge port wall 24 forming the discharge port Pout in the housing 20. The nameplate 60 is provided on the suction port wall 23 forming the suction port Pin. Since the nameplate 60 is attached to the part of the housing 20 where the temperature is relatively low, the adhesive layer 61 may be maintained stably. The reliability in attaching the nameplate 60 to the suction port wall 23 may be increased.

(Modification)

The above embodiments may be modified in various manner as exemplified below. The above embodiments and the following modifications may be combined within a technically consistent range.

Although the nameplate 60 is a sticker in the above embodiments, the nameplate 60 may be made of a metal plate. In this case, the nameplate 60 may be fixed to the nameplate mounting leg 26 or the suction port wall 23 using a fixing member such as a bolt. When the nameplate 60 is fixed with the fixing member, the adhesive layer 61 may be omitted.

In the above embodiments, the shape of the nameplate 60 is not limited to a rectangular shape, but may be changed suitably.

In the second embodiment, the seat portion 23*b* may be omitted. The nameplate 60 may be adhered to a cylindrical surface of the suction port wall 23 with the adhesive layer 61 interposed therebetween.

In the first embodiment, the flat plate 26*a* may be omitted. The nameplate 60 may be adhered to any suitable part of the nameplate mounting leg 26 with the adhesive layer 61 interposed therebetween.

In the second embodiment, the nameplate 60 may be provided on the discharge port wall 24 forming the discharge port Pout. The discharge port wall 24 is a protrusion protruding out of the soundproof cover 70. The seat portion 23*b* may be formed in the discharge port wall 24. In addition, the nameplate 60 may be adhered to any part of the discharge port wall 24 with the adhesive layer 61 interposed therebetween.

In the first embodiment, the nameplate 60 may be attached to the mounting legs 25 other than the nameplate mounting leg 26. The mounting legs are protrusions protruding out of the soundproof cover 70. The flat plate 26*a* may be formed in any of the mounting legs 25 other than the nameplate mounting leg 26. The nameplate 60 may be adhered to any suitable part of the mounting legs 25 other than the nameplate mounting leg 26 with the adhesive layer 61 interposed therebetween.

In the above embodiments, two or more nameplates 60 may be provided. For example, when two nameplates 60 are provided, both of the two nameplates 60 may be attached to one of the mounting legs 25, the suction port wall 23, or the discharge port wall 24. Alternatively, one of the two nameplates 60 may be attached to one of the mounting legs 25, and the other of the two nameplates 60 may be attached to the suction port wall 23. When three or more nameplates 60 are provided, parts where the nameplates 60 are attached may be changed similarly.

In the above embodiments, the number of the mounting legs 25 and the positions of the mounting legs 25 may be changed suitably.

In the above embodiments, the compression part 30 is not limited to a scroll type, but may be a piston type or a vane type.

Although the soundproof cover 70 includes the first cover 71 and the second cover 72 in the above embodiments, the soundproof cover 70 may be formed of three or more covers.

In the above embodiments, the mounting object to which the electric compressor 10 is mounted may be an engine, for example. In short, the mounting object to which the electric compressor 10 is mounted is not limited to any particular part of the vehicle.

The electric compressor 10 may be mounted to a fuel cell vehicle and configured to compress air as a fluid to be supplied to a fuel cell with the compression part 30.

What is claimed is:

1. An electric compressor comprising:
- a compression part configured to compress fluid;
- an electric motor configured to drive the compression part;
- a housing accommodating the compression part and the electric motor;
- a soundproof cover covering the housing; and
- a nameplate attached to the housing and including a predetermined information, wherein
  - the housing includes a protrusion that is a part of the housing and protrudes out of the soundproof cover through a hole formed in the soundproof cover, and
  - the nameplate is provided on the protrusion; and
- further comprising a seat portion arranged between the nameplate and the protrusion, wherein the seat portion has a different shape from both the nameplate and the protrusion.

2. The electric compressor according to claim 1, wherein the protrusion is a mounting leg for mounting the electric compressor to a mounting object.

3. The electric compressor according to claim 1, wherein the protrusion is a wall forming a port through which the fluid is introduced or discharged.

4. The electric compressor according to claim 2, wherein the housing includes:
- a suction port through which the fluid to be compressed in the compression part is introduced, and
- a discharge port through which the fluid compressed in the compression part is discharged, the housing has a plurality of the mounting legs, and the nameplate is provided on one mounting leg of all of the mounting legs, the one mounting leg being positioned farthest from the discharge port.

5. The electric compressor according to claim 3, wherein the port includes:
- a suction port through which the fluid to be compressed in the compression part is introduced, and
- a discharge port through which the fluid compressed in the compression part is discharged, and the nameplate is provided on the wall forming the suction port.

6. The electric compressor according to claim 1, wherein the nameplate is flat.

7. An electric compressor comprising:

a compression part configured to compress fluid;

an electric motor configured to drive the compression part;

a housing accommodating the compression part and the electric motor;

a soundproof cover covering the housing; and a nameplate attached to the housing and including a predetermined information, wherein the housing includes a protrusion that is a part of the housing and protrudes out of the soundproof cover through a hole formed in the soundproof cover, and the nameplate is provided on the protrusion; and further comprising a flat plate arranged between the nameplate and the protrusion, wherein the flat plate has a different shape from both the nameplate and the protrusion.

8. The electric compressor according to claim 7, wherein the protrusion is a mounting leg for mounting the electric compressor to a mounting object.

9. The electric compressor according to claim 1, wherein the protrusion is a wall forming a port through which the fluid is introduced or discharged.

10. The electric compressor according to claim 8, wherein the housing includes:

a suction port through which the fluid to be compressed in the compression part is introduced, and a discharge port through which the fluid compressed in the compression part is discharged, the housing has a plurality of the mounting legs, and the nameplate is provided on one mounting leg of all of the mounting legs, the one mounting leg being positioned farthest from the discharge port.

11. The electric compressor according to claim 9, wherein the port includes:

a suction port through which the fluid to be compressed in the compression part is introduced, and a discharge port through which the fluid compressed in the compression part is discharged, and the nameplate is provided on the wall forming the suction port.

12. The electric compressor according to claim 7, wherein the nameplate is flat.

* * * * *